United States Patent [19]

Ching

[11] Patent Number: 4,759,576

[45] Date of Patent: Jul. 26, 1988

[54] ADJUSTABLE DEADLATCH

[75] Inventor: Hui P. Ching, Mei Foo Sun Chuen, Hong Kong

[73] Assignee: Kambo Security Products Ltd., Kowloon, Hong Kong

[21] Appl. No.: 884,712

[22] Filed: Jul. 11, 1986

[51] Int. Cl.[4] ..... E05C 1/16

[52] U.S. Cl. ..... 292/337; 292/DIG. 60

[58] Field of Search ..... 292/337, DIG. 60, 1, 292/169, DIG. 44, 169.23; 70/134, 143, 461, 422, 448

[56] References Cited

U.S. PATENT DOCUMENTS

| | | | |
|---|---|---|---|
| 504,292 | 8/1893 | Badoni | 70/461 |
| 1,661,454 | 3/1928 | Wilson | 292/337 X |
| 1,701,790 | 2/1929 | Movin | 292/DIG. 44 X |
| 2,518,207 | 8/1950 | Wagner | 292/337 |
| 4,372,594 | 2/1983 | Gater | 292/DIG. 60 X |
| 4,602,490 | 7/1986 | Glass et al. | 292/DIG. 60 X |
| 4,653,787 | 3/1987 | Fang | 292/337 |
| 4,662,665 | 5/1987 | Lin | 292/337 X |
| 4,664,433 | 5/1987 | Solovieff | 292/337 |
| 4,679,420 | 7/1987 | Yang | 70/222 X |
| 4,687,239 | 8/1987 | Lin | 292/172 |

*Primary Examiner*—Lloyd A. Gall

*Attorney, Agent, or Firm*—Charles H. Schwartz; Ellsworth R. Roston

[57] ABSTRACT

An adjustable deadlatch for a lockset for adjusting to either of two backset positions, including a first cylindrical member having a first particular diameter. A second cylindrical member has a second diameter larger than the first diameter and with the first and second cylindrical members located in a telescopic arrangement. A detent is formed between the first and second cylindrical members and has two longitudinal locking detent positions corresponding to the two backset positions. A deadbolt is located within the first cylindrical member and includes a longitudinal opening. A longitudinal portion of an actuating member is located within the longitudinal opening in the deadbolt. The longitudinal portion includes a longitudinal slot having a length corresponding to the distance between the two backset positions. A pin member passes through the deadbolt and has an inner end located in and guided by the slot. A telescopic adjustment of the cylindrical members between the two detent positions provides for an adjustment of the pin in the slot and thereby an adjustment of the deadlatch corresponding to the two backset positions.

15 Claims, 2 Drawing Sheets

FIG. 1
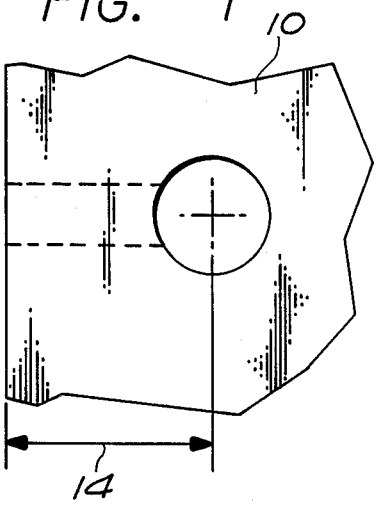
FIG. 2
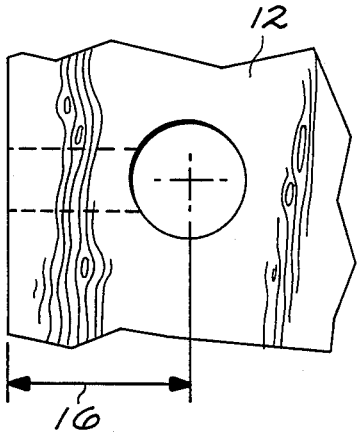
FIG. 3
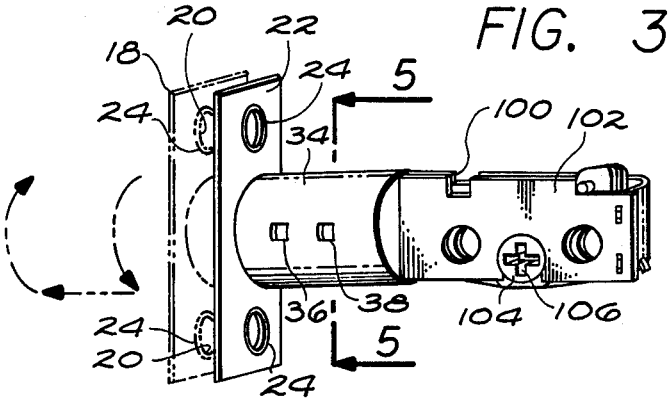
FIG. 4
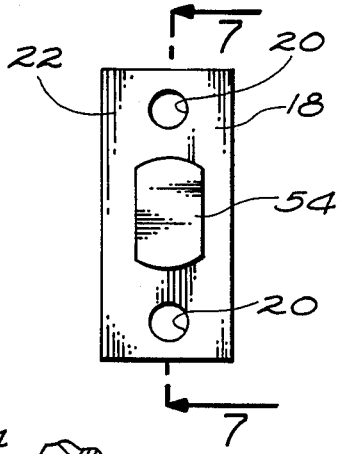
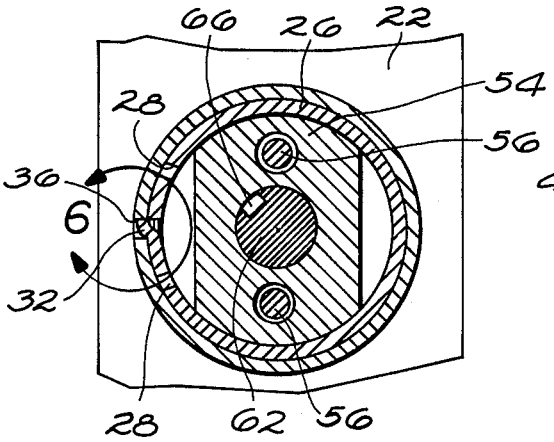
FIG. 5
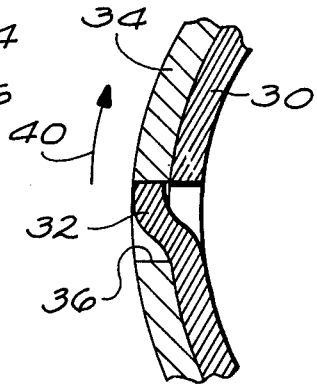
FIG. 6

ADJUSTABLE DEADLATCH

BACKGROUND OF THE INVENTION

1. Field of the Invention

The present invention relates to an adjustable deadlatch. Specifically the invention relates to a deadlatch which is adjustable between a $2\frac{3}{8}''$ or a $2\frac{3}{4}''$ backset.

2. Description of the Prior Art

Entry doors are typically made to accept deadlatch locks having backsets of either one of two sizes. The normal wooden household door typically uses a deadlatch lock having a backset of $2\frac{3}{8}''$. Heavy duty metal doors which may be used for commercial or industrial purposes or may be used for residential purposes, typically has a deadlatch lock having a backset of $2\frac{3}{4}''$. These metal doors are normally sold with a premade opening for a $2\frac{3}{4}''$ backset for the latch.

In the past, separate deadlatches were used depending upon the particular backset. Specifically, if the door required a deadlatch having a $2\frac{3}{8}''$ backset, a deadlatch having this dimension was used with the lock. On the other hand, if the door required a deadlatch with a $2\frac{3}{4}''$ backset, this size deadlatch was provided even though the remaining portions of the lockset might be identical to the lockset used with the $2\frac{3}{8}''$ backset latch. In other words, the only difference between the locks for use with either the $2\frac{3}{8}''$ or $2\frac{3}{4}''$ backsets was the deadlatch itself.

It has, therefore been considered desirable to provide for an adjustable deadlatch that can be used for either a $2\frac{3}{8}''$ or $2\frac{3}{4}''$ backset. This would eliminate the cost of manufacturing two separate deadlatches and would also eliminate the necessity of stocking a double inventory for complete lock sets or for deadlatches. An adjustable deadlatch could, therefore, greatly simplify the inventory requirement and thereby reduce the cost of stocking this double inventory.

Unfortunately the adjustable deadlatches provided by the prior art have been complicated in structure and cumbersome in operation. For example, one such structure includes a number of arm members which must be pivoted out of the way such as by a pin member extending outwardly from the deadlatch. The pin member is then pushed to translate a portion of the latch structure between the $2\frac{3}{8}''$ and $2\frac{3}{4}''$ backset positions. The arm members must then be pivoted back to lock the structure deadlatch in position. Other prior art devices include removable pieces which must be extracted and repositioned or removed completely and all of these prior art devices do not provide for a simple, reliable and easily operated adjustable deadlatch latch.

SUMMARY OF THE INVENTION

The present invention relates to an adjustable deadlatch which includes a positive and simple structure for adjusting the deadlatch between $2\frac{3}{8}''$ and $2\frac{3}{4}''$ backset positions. The actual adjustment is provided by an interior structure having a pin permanently engaged in a slot. The pin passes through the deadbolt member and is received in a slot contained in a longitudinal rod portion of an actuating member inter-connecting the bolt member with the remaining operating structure of the lockset.

The slot has a U-shaped configuration and with the pin when located within the upturned ends of the U-shaped slot representing the $2\frac{3}{4}''$ and $2\frac{3}{8}''$ backset positions. In order to control the movement of the pin in the slot between the different backset positions, the present invention includes a detent means having locked positions and unlocked positions. When in the locked position, the pin is locked within the upturned ends of the U-shaped slot. When in the unlocked position, movement of the pin in the slot is allowed between the two extremities of the U-shaped slot.

Specifically the detent is formed by two openings representing the $2\frac{3}{8}''$ and $2\frac{3}{4}''$ positions in a first member and with either of these openings cooperating with a spring biased raised area in a second member which may be captured in either one of the openings to lock the deadlatch in the different backset positions. The detent means is formed between cooperating cylindrical members to allow for both relative rotation and longitudinal movement between the cylindrical members.

The adjustment between the backset positions is provided by rotating the cylindrical members in a first direction to release the raised area from one of the openings. At the same time, the rotation in the first direction moves the pin down one of the upturned ends of the U-shaped slot. The cylindrical members may now be moved longitudinal relative to each other which in turn moves the pin through the bottom portion of the U-shaped slot. The cylindrical members are then rotated in a second direction opposite to the first direction to move the pin up the other of the upturned ends of the U-shaped slot and to have the raised area now locked within the other one of the openings. The deadlatch has now been adjusted from one backset position to the other.

BRIEF DESCRIPTION OF THE DRAWINGS

A clearer understanding of the present invention will be had with reference to the following description and drawings wherein:

FIG. 1 illustrates an entry door having a first backset location for a deadlatch;

FIG. 2 illustrates an entry door having a second backset position for a deadlatch;

FIG. 3 is a perspective view of an adjustable deadlatch constructed in accordance with the teachings of the present invention which deadlatch may be used with either of the entry doors shown in FIGS. 1 or 2;

FIG. 4 is a front view of the deadlatch of FIG. 3;

FIG. 5 is a cross-sectional view taken along lines 5—5 of FIG. 3;

FIG. 6 is an exploded view of the detent portion which exploded view is represented by the area within the arrow 6 shown in FIG. 5;

DESCRIPTION OF THE PREFERRED EMBODIMENT

Figure 7:
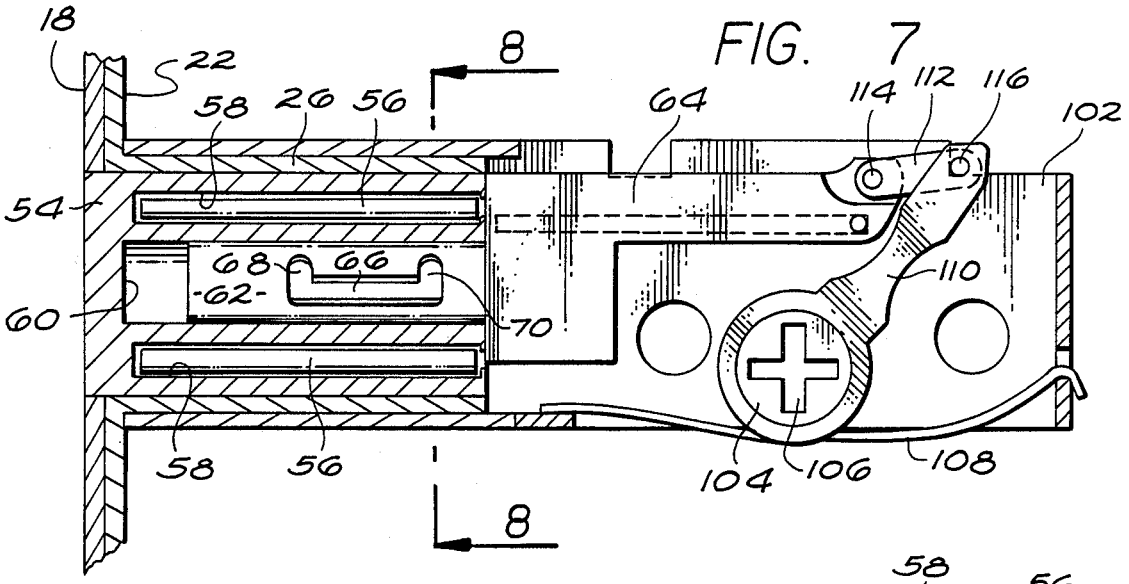
FIG. 7 is a cross-sectional view taken along lines 7—7 of FIG. 4.

As shown in FIGS. 1 and 2, entry doors 10 and 12 having different backsets are shown. It is to be appreciated that the term entry door is used to indicate a door leading from the outside to the inside of a building. This is the type of door that normally would use a deadlatch type of latch bolt. However, it is to be appreciated that the invention may be used with any type of door whether exterior or interior.

As shown in FIGS. 1 and 2, the backset represented by arrow 14 in FIG. 1 and arrow 16 in FIG. 2 has different distances. This is because heavier metal doors, such as shown in FIG. 1, typically have a backset of 2¾". On the other hand, wooden doors such as the door shown in FIG. 2 typically have a backset of 2⅜".

In order to accommodate the different backsets, either separate length deadlatches must be used with locksets when the lockset is to be installed on doors with different backsets, or an adjustable deadlatch must be used so that the locksets can accommodate doors with different backsets.

FIGS. 3 through 9 illustrate a specific embodiment of an adjustable deadlatch constructed in accordance with the teachings of the present invention which deadlatch may be used with a lockset to accommodate the two different backset positions shown in FIGS. 1 and 2. These two different backset distances are respectively 2¾" for the backset position for the door of FIG. 1 and 2⅜" for the backset position for the door of FIG. 2. The adjustable deadlatch includes a face plate 18 which has openings 20 for receiving screws to lock the deadlatch to the edge of the door.

Attached to the face plate 18 is a back plate 22 which is attached to the front plate 18 by integral rivets 24. Specifically the rivets 24 are formed as an extension of the material around the openings 20. The rivets pass through complementary openings in the back plate 22 and are riveted over to lock the front plate and back plate together.

Extending from the back plate 22 is a cylindrical member 26. The cylindrical member 26 includes a U-shaped slot 28 to form a spring flap portion 30 of the cylindrical member. The spring flap portion 30 further includes a raised area 32 which raised area is formed by cutting a portion of the spring member 30 on three (3) sides and upsetting the cut portion to have it stand away from the spring portion 30 as shown in FIGS. 5 and 6.

The cylindrical member 26 fits within a complementary cylindrical member 34 in telescopic fashion. Specifically the cylindrical members 26 and 34 may rotate relative to each other and be moved longitudinally relative to each other. However, the cylindrical members may be locked in two positions. In particular the cylindrical member 34 includes a pair of rectangular openings 36 and 38 so that the raised area 32 may be locked within either of the openings 36 or 38.

The raised area 32 may be released from its locked position in either of the openings 36 or 38 by rotating the cylindrical member 34 in the direction shown by the arrow 40 so that a wall portion of either of the openings 36 or 38 ramps upward against the bottom curved portion of the raised area 32. This tends to push the spring flap portion 30 inward so that the raised area 32 will be released from either of the openings 36 or 38 to thereby permit the cylindrical members to be freely moveable relative to each other. This allows adjustment between the cylindrical members so that the raised area 32 may be locked within either of the openings 36 or 38.

The adjustment operation between the two cylindrical members is therefore as follows. If the raised area 32 is locked in either of the openings 36 or 38 which correspond to a first backset position, the cylinder 34 is rotated in the direction shown by the arrow 40 to unlock the raised area. The cylinders 34 and 26 are moved longitudinally in telescopic fashion to a second backset position and the cylinder 34 is then rotated in the direction opposite to the arrow 40 to lock the cylinders together in the second backset position.

Figure 8:
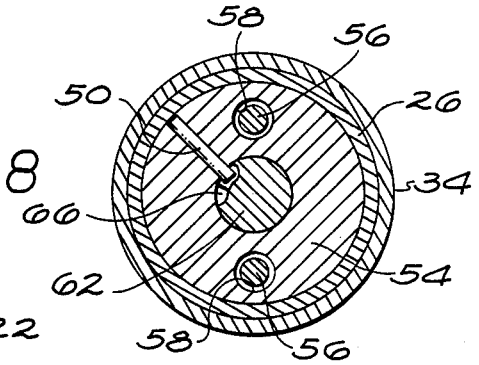
FIG. 8 is a cross-sectional view taken along lines 8—8 of FIG. 7.
Figure 9:
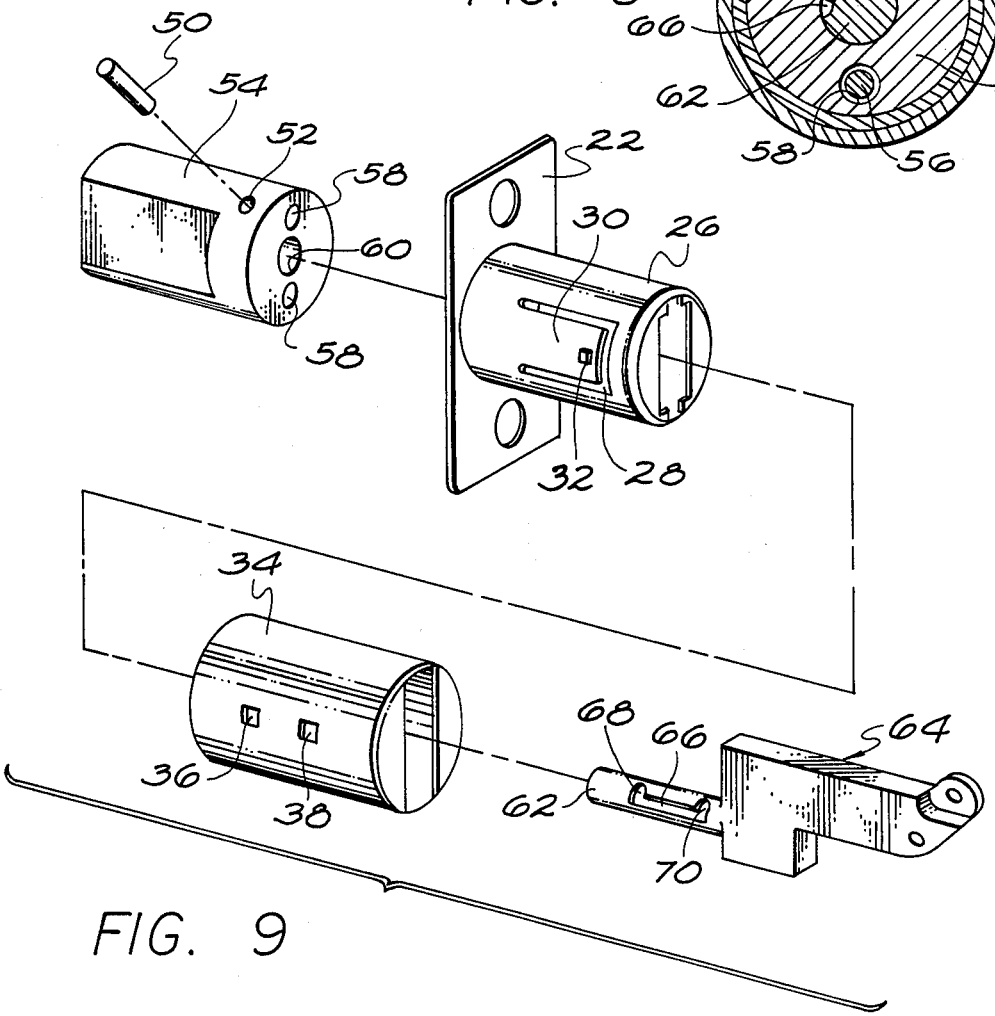
FIG. 9 is an exploded view of the adjustable portion of the deadlatch of the present invention.

The actual control of the specific rotational and longitudinal movement of the adjustable deadlatch of the present invention is provided by an interior pin and slot which are shown in detail in FIGS. 8 and 9. In particular, a pin member 50 is positioned within an opening 52 in a deadbolt 54. The deadbolt may be of a standard type including hard steel pins 56 freely received in openings 58. If an attempt is made to cut the deadbolt with a hacksaw blade, the pins 56 will freely rotate on the blade teeth and prevent any cutting action.

The deadbolt 54 further includes a round central opening 60. The opening 60 is designed to receive a longitudinal rod portion 62 of an actuating member 64. The rod portion 62 includes a U-shaped slot 66 which slot receives the inner end of the pin 50. The deadbolt 54 is, therefore, interconnected with the actuating member 64 through the use of the pin 50 captured within the slot 66. When the pin 50 is captured within either of the upturned end portions 68 or 70 of the U-shaped slot 66, the deadbolt 54 and the actuating member 64 are locked together so that any longitudinal movement of the actuating member 64 provides for a corresponding longitudinal movement of the deadbolt 54.

It can, therefore, be seen that the deadlatch 54 may be locked onto the deadlatch member 64 at either of the upturned end portions 68 and 70 which positions correspond to the two backset positions shown in FIGS. 1 and 2. The positions of the upturned end portions also correspond to the detent positions represented by the openings 36 and 38. When as explained above, the cylindrical members 26 and 34 are rotated relative to each other to unlock the detent, then the pin member 50 is released from the end portions 68 and 70. The pin 50 can now slide in the bottom portion of the slot 66 to be translated between the positions of the end portions 68 and 70, and thereby provide for the adjustment to the different backset positions.

The actuating member 64 is actually retained between a pair of support arms 100 and 102. A rotatable member 104 having a crossed key slot 106 is supported between the arm members 100 and 102 for rotation. A spring member 108 provides spring tension during rotation. Extending from the rotatable member 104 is an arm portion 110. A pivotable link 112 is pivotably connected with pin members 114 and 116 between the actuating arm 64 and the arm portion 110. Rotation of the rotatable member 104, therfore, provides for translation of the actuating arm 64 and in turn the deadbolt 54 is also moved outward. The same actuation occurs whether the adjustable deadlatch is in either of the two backset positions. The only difference is that the cylinders 26 and 34 are telescoped and locked by the detent relative to each other in one of the two backset positions and the pin 50 is locked in the corresponding one of the upturned portions 68 or 70 depending upon the backset position.

The present invention, therefore, provides for a simple adjustment between two backset positions by first providing a rotational movement of one cylindrical member relative to another to unlock a detent and an interior pin from a first backset position and then longitudinal moving the cylindrical members to move the interior pin along a slot and with a counter rotational movement of the cylindrical members to lock the detent and the pin in a second backset position. The adjustable deadlatch of the present invention may, therefore, be rapidly adjusted between either one of two backset positions such as a $2\frac{3}{8}''$ backset position or a $2\frac{3}{4}''$ backset position.

Although the invention has been described with reference to a particular embodiment, it is to be appreciated that various adaptations and modifications may be made and the invention is only to be limited by the appended claims.

I claim:

1. An adjustable deadlatch for a lockset for adjusting to either of two backset positions for a lockset, including a first cylindrical member having a first particular diameter, a second cylindrical member having a second diameter larger than the first diameter and with the first and second cylindrical members located in a telescopic arrangement for providing a telescopic adjustment between the cylindrical members, detent means interconnected between the first and second cylindrical members and having two longitudinal detent positions corresponding to the two backset positions for locking the cylindrical members together in two detent positions, a deadbolt located within the first cylindrical member and including a longitudinal opening in the deadbolt, an actuating member including a longitudinal portion located within the longitudinal opening in the deadbolt, the longitudinal portion of the actuating member including a longitudinal slot having a length corresponding to the distance between the two backset positions and additionally including a pin member passing through the deadbolt and with an inner end of the pin member located in and guided by the slot, and the telescopic adjustment of the cylindrical members between the two detent positions providing for an adjustment of the pin in the slot corresponding to the two backset positions.

2. The adjustable deadlatch of claim 1 wherein, the detent means is formed by a raised area on one of the two cylindrical members and a pair of opening in the other cylindrical member forming the two detent positions to have either of the openings receive the raised area to lock the cylindrical members in the two detent positions.

3. The adjustable deadlatch of claim 2, additionally including the raised area formed in a flap portion of the one cylindrical member and with the flap portion forming a spring member to urge the raised area against the other cylindrical member and into either of the two openings.

4. The adjustable deadlatch of claim 3 wherein, the raised area is formed with at least one cut side to provide a stop against relative movement between the cylindrical members in at leasat one direction when the raised area is received within either of the two openings and with the size of the raised area opposite the cut side curved outwardly to form a ramping surface to allow the raised area to be released from either of the two openings upon relative movement between the cylindrical members in at least the direction opposite to the one direction.

5. The adjustable deadlatch of claim 4 wherein, the directions of movement to release and lock the raised area from and within either opening is a rotary movement and with the telescopic adjsutment provided by a longitudinal movement between the cylindrical members perpendicular to the rotary movement.

6. The adjustable deadlatch of claim 5 wherein, the longitudinal slot has upturned end portions to form a U-shaped slot to guide the rotational and longitudinal movement of the cylindrical members and to prevent longitudinal movement between the deadbolt and the actuating member when the pin is located within either of the upturned end portions of the U-shaped slot.

7. The adjustable deadlatch of claim 1 wherein, the longitudinal opening in the deadbolt is round and along a central axis and forms an inside round surface and the longitudinal poriton of the actuating member is round and has an outside round surface and the slot in the longitudinal portion is formed along the outside round surface.

8. The adjustable deadlatch of claim 7 wherein, the slot has upturned end portions to form a U-shaped slot to prevent longitudinal movement between the deadbolt and the actuating member when the pin is located within either of the upturned end portions of the U-shaped slot.

9. The adjustable deasdlatch of claim 8 wherein, the detent means is spring biased.

10. The adjustable deasdlatch of claim 9 wherein, the spring biased detent means is unlocked only by relative movement between the cylindrical members in the direction to move the pin down the upturned end portions of the U-shaped slot.

11. The adjustable deadlatch of claim 1 wherein, the deadbolt is contained within the first cylindrical member, the first cylinddrical member is contained within the second cylindrical member and at least the longitudinal portion of the actuating member is contained within the deadbolt and thereby contained within the first and second cylindrical members.

12. An adjustable deadlatch for adjusting to either of two backset positions, including a first cylindrical member having a first particular diameter, a second cylindrical member having a second diameter larger than the first diameter and with the first and second cylindrical members located in a telescopic arrangement for providing a telescopic adjustment between the cylindrical members, detent means interconnected between the first and second cylindrical members and having two longitudinal detent positions corresponding to the two backset positions for locking the cylindrical members together in two detent positions, a deadbolt located within the first cylindrical member, an actuating member adjustably coupled to the deadbolt for actuating the deadbolt between open and closed positions, the telescopic adjustment of the cylindrical members between the two detent positions providing for an adjustment of the coupling between the actuating member and the deadbolt corresponding to the two backset positions, the detent means formed by a raised area on one of the two cylindrical members and a pair of openings in the other cylndrical member to form the two detent positions to have either of the openings receive the raised area to lock the cylindrical members in the two detent positions, the raised area formed in a flap portion of the one cylindrical member and with the flap portion forming a spring member to urge the raised area against the other cylindrical member and into either of the two openings, and the raised area formed with at least one cut side to provide a stop against relative movement between the cylindrical members in at least one direction when the raised area is received within either of the two openings and with the side of the raised area opposite the cut side curved outwardly to form a ramping surface to allow the raised area to be released from either of the two openings upon relative movement between the cylindrical members in at least the direction opposite to the one direction.

13. The adjustable deadlatch of claim 12 wherein, the directions of movement to release and lock the raised area from and within either opening is a rotary movement and with the telescopic adjustment provided by a longitudinal movement between the cylindrical members perpendicular to the rotary movement.

14. The adjustable deadlatch of claim 13 wherein, the adjustable coupling between the deadbolt and actuating member includes a pin within a longitudinal slot and the longitudinal slot having upturned end portions to form a U-shaped slot to guide the rotational and longitudinal movement of the cylindrical members and to prevent longitudinal movement between the deadbolt and the actuating member when the pin is located within either of the upturned end portions of the U-shaped slot.

15. The adjustable deadlatch of claim 14 wherein, the spring biased detent means is unlocked only by relative movement between the cylindrical members in the direction to move the pin down the upturned end portions of the U-shaped slot.

* * * * *